US005944423A

United States Patent [19]

Rabin et al.

[11] Patent Number: 5,944,423

[45] Date of Patent: Aug. 31, 1999

[54] BAG FILE FOR SUSPENSION FILING SYSTEM

[75] Inventors: Edward Rabin; John Russo, both of Westport, Conn.

[73] Assignee: Monaco, LLC, Bethel, Conn.

[21] Appl. No.: 09/054,582

[22] Filed: Apr. 3, 1998

[51] Int. Cl.[6] ..... B65D 33/06

[52] U.S. Cl. ..... 383/15; 229/67.2; 229/67.4; 383/22

[58] Field of Search ..... 383/15, 22, 23; 281/45; 283/36; 40/359; 312/184; 211/425; 229/67.1, 67.2, 67.3, 67.4

[56] References Cited

U.S. PATENT DOCUMENTS

| | | | |
|---|---|---|---|
| 3,452,922 | 7/1969 | Hart . | |
| 3,462,068 | 8/1969 | Suominen . | |
| 3,477,634 | 11/1969 | Kamins et al. . | |
| 3,486,683 | 12/1969 | Kamins et al. . | |
| 3,529,317 | 9/1970 | Schwarzkopf . | |
| 3,664,051 | 5/1972 | Benichou . | |
| 3,801,175 | 4/1974 | Giulie . | |
| 3,885,726 | 5/1975 | Fridlund et al. . | |
| 3,957,321 | 5/1976 | Rose . | |
| 4,031,646 | 6/1977 | De Nouel . | |
| 4,053,057 | 10/1977 | Snowden . | |
| 4,079,533 | 3/1978 | Rohner . | |
| 4,236,770 | 12/1980 | Moore et al. . | |
| 4,641,360 | 2/1987 | Frank | 383/15 |
| 4,893,745 | 1/1990 | Weber et al. | 229/67.2 |
| 5,048,697 | 9/1991 | Payne . | |
| 5,261,636 | 11/1993 | Hawes, Jr. et al. . | |
| 5,328,259 | 7/1994 | Meriaux . | |
| 5,545,087 | 8/1996 | Seward | 229/67.2 X |

*Primary Examiner*—Jes F. Pascua
*Assistant Examiner*—Robin Hylton
*Attorney, Agent, or Firm*—St. Onge Steward Johnston & Reens, LLC

[57] ABSTRACT

A suspension bag for a suspension filing system is described wherein elongate plastic closure bars are used and affixed to upper edges of plastic bags. The closure bars releasably interlock with each other and are separable for a sufficient distance to form a bag opening for the insertion of articles to be stored in the suspension bag. A sufficient bag opening can be achieved by reducing the length of the upper bag portion that is attached to the closure bars or by providing corner cut outs or with the use of gussets. The bags are preferably formed of transparent material though opaque materials could be used.

6 Claims, 3 Drawing Sheets

BAG FILE FOR SUSPENSION FILING SYSTEM

FIELD OF THE INVENTION

This invention generally relates to a suspension filing system using bags hung from suspension bars. More specifically, this invention relates to a suspension bag for use in such suspension filing system.

BACKGROUND OF THE INVENTION

Suspension filing systems are well known such as marketed under the Pendaflex trademark. Typically, the suspension filing system uses hanging folders which include steel bars that span across the open space over a file drawer and rest upon side rails located on the side of the drawer. The steel bars are captured inside upper folded over segments of the hanging folders and thus can support the contents stored inside the folder. Typically, these conventional folders are open on the top as well as their sides to easily receive papers and the like, though papers can and often do tend to fall out from the sides.

Hanging folders using bags are also known. See for example U.S. Pat. No. 5,226,734 in which a hanger bag assembly is shown and described for mounting on side rails in a suspension filing system. In this patent the bag is suspended from a single hanger rod, which in turn has side located notches for riding on side rails along the file drawer. The hanger bag has an envelope type opening through which articles can be stored in the bag by accessing it from the side. Other suspension filing systems are shown in U.S. Pat. No. 5,413,215 for storing disks and U.S. Pat. No. 5,570,833 for a locking mechanism attached to a conventional hanging folder.

A bag for hanging from rods is shown in U.S. Pat. No. 3,452,922 and includes a transparent bag whose upper opening sides are respectively affixed to a pair of handles. The handles in turn are connectable and separable through interlocking male and female fasteners. Other similar bag handles and with the use of transparent bags have been described in the art and are commercially available.

Although these prior art bags are effective, the need to store articles such as disks, tapes and booklets in suspension type filing systems makes it desirable to be able to use suspension bags which are easy to open while they are mounted in a suspension file and yet are sturdy and reliably retain the articles.

SUMMARY OF THE INVENTION

It is, therefore, an object of the invention to provide a suspension bag which is easy to use, convenient to install and reliably retains articles stored in the bags.

One suspension bag in accordance with the invention involves a bag shaped and sized to hang inside a suspension filing system as is commonly found in file drawers. The suspension bag has a sealed or otherwise closed bottom and sides with an upper opening bounded by opposed upper edges. The upper edges in turn are connected to elongate closure bars whose lengths exceed the width of the bag so as to extend past its sides to rest upon the side rails. The closure bars have interlocking separable male and female closure elements so as to enable convenient access into the bag.

With one suspension bag in accordance with the invention the connection of the bag to the closure bars is limited at the upper side corners to leave sufficient play for the bag to be widely opened while it is installed in a file system. An alternate approach to obtain an adequate opening of the bag is to employ side located gussets that enable the bag to be opened to a desired width without tearing at the closure bars. The closure bars are provided with thumb slots in their upper edges for ease of opening.

This and other objects and advantages of the invention can be understood from the following detailed description of the invention as shown in the drawings.

DETAILED DESCRIPTION OF DRAWINGS

Figure 2:
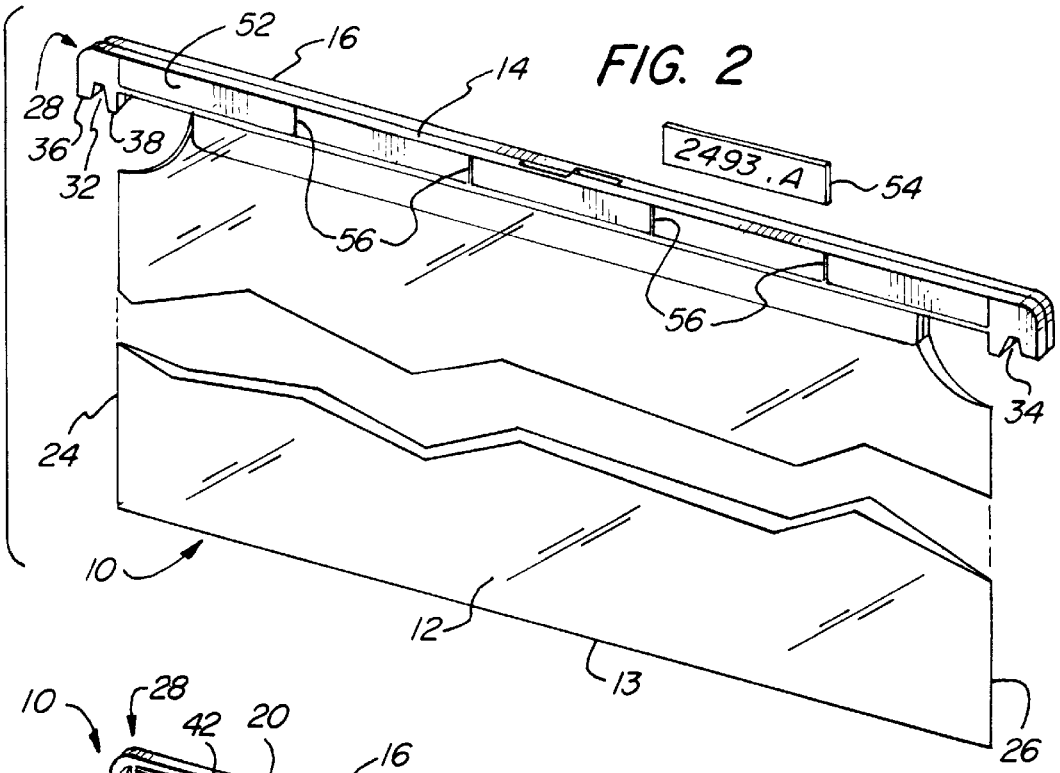
FIG. 2 is a perspective partially broken away view of the closed suspension bag of FIG. 1.

With reference to FIGS. 1–6 a suspension bag 10 in accordance with the invention is shown formed of a transparent bag 12 having a closed bottom 13 and sides is attached to interlocking elongate closure bars 14, 16. The bag 12 can be transparent or opaque, with transparent preferred when the contents to be stored in the suspension bag are to be visible from the outside. The bag 12 can, even when it is transparent, be carrying appropriate printing. The bag 12 can be made from a transparent thin polyethylene material that can be heat sealed to the closure bars 14,16.

The closure bars 14,16 are complementary shaped and preferably made of an injection molded plastic material. The thickness of the bars preferably is made as small as is practicable given the need to maintain sufficient rigidity. Generally each of the bars can be less than about $3/16^{th}$ of an inch in thickness though different sizes can be accommodated. The inner facing sides 18, 20 are hollowed out and provided with re-enforcing ribs 22 some of which are angled to enhance the rigidity of the bars and prevent their sagging when bag 12 is weighted down with heavy contents.

Figure 4:
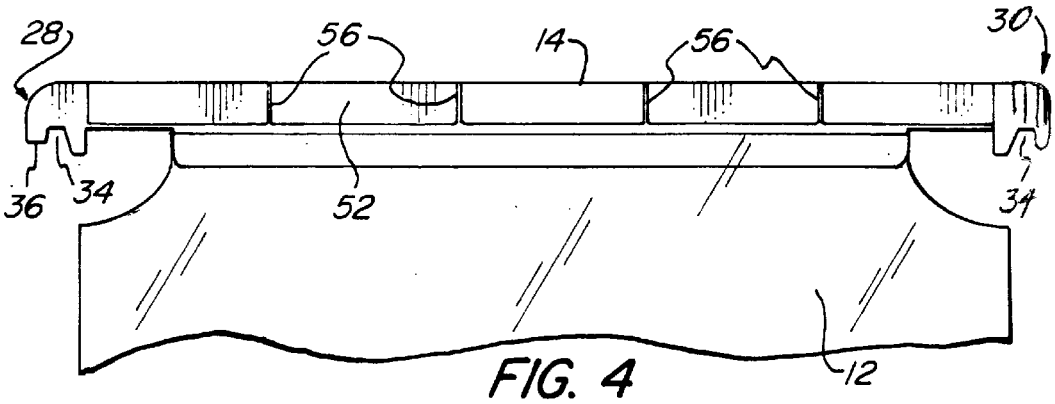
FIG. 4 is a partial view in elevation of the suspension bag of FIG. 1.

The closure bars 14, 16 are sized to extend past the sides 24, 26 of the bag 12 with end segments 28, 30 adapted to slide on side rails, not shown, of a suspension filing system as shown at FIG. 4 in the aforementioned U.S. Pat. No. 5,226,734. The end segments 28, 30 are provided with recesses 32, 34 in which a side rail is captured to laterally align the suspension bag 10. The recesses 28, 30 are formed by spaced apart protrusions 36, 38, though the recesses 32, 34 could be formed in the main body of the plastic closure bars 14,16 and an alignment of the closure bars on the side rails could be obtained with the use of a single protrusion, such as 36, at the end segments 28, 30.

The closure bars 14, 16 can be closed with the use of respectively aligned male and female interlocking elements

Figure 1:
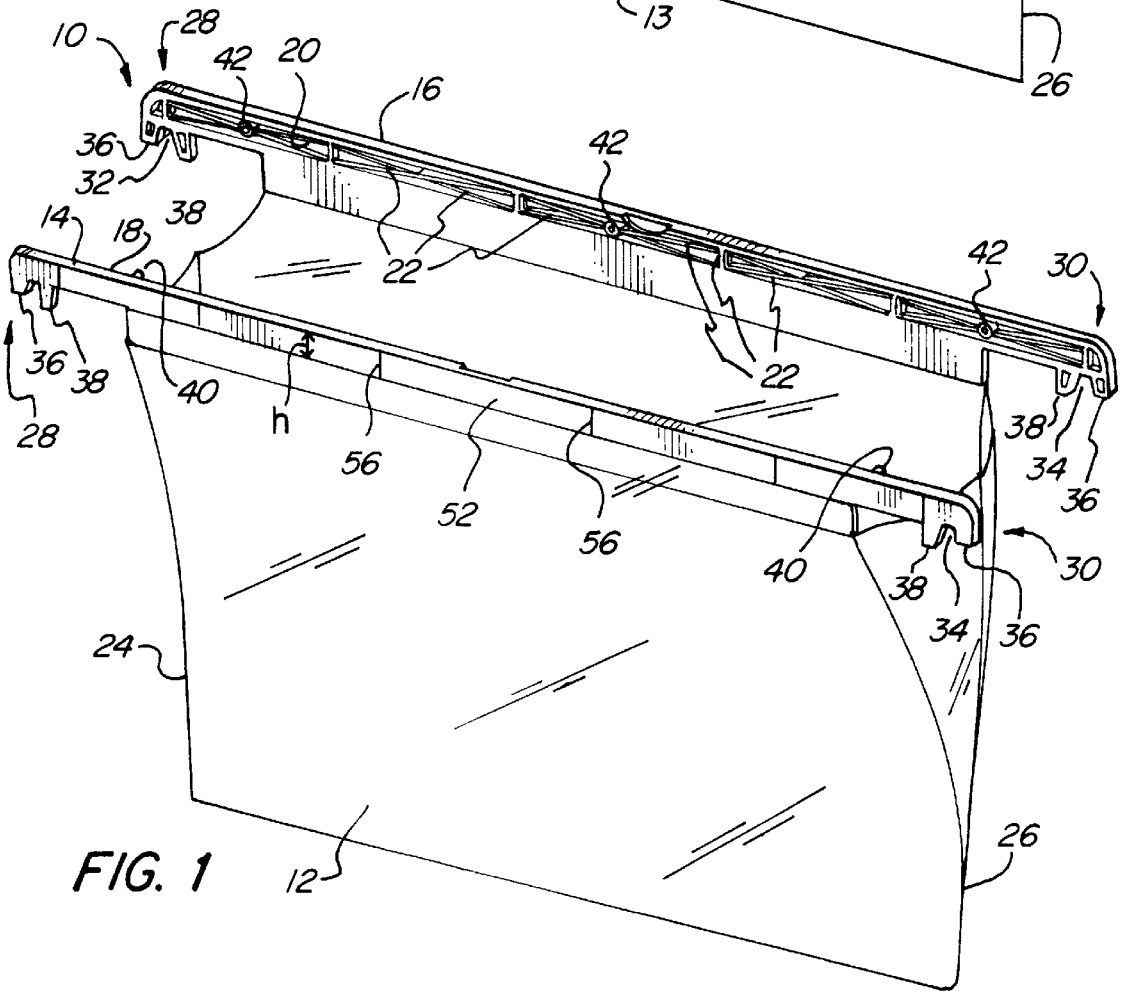
FIG. 1 is a perspective view of an opened suspension bag in accordance with the invention.
Figure 3:
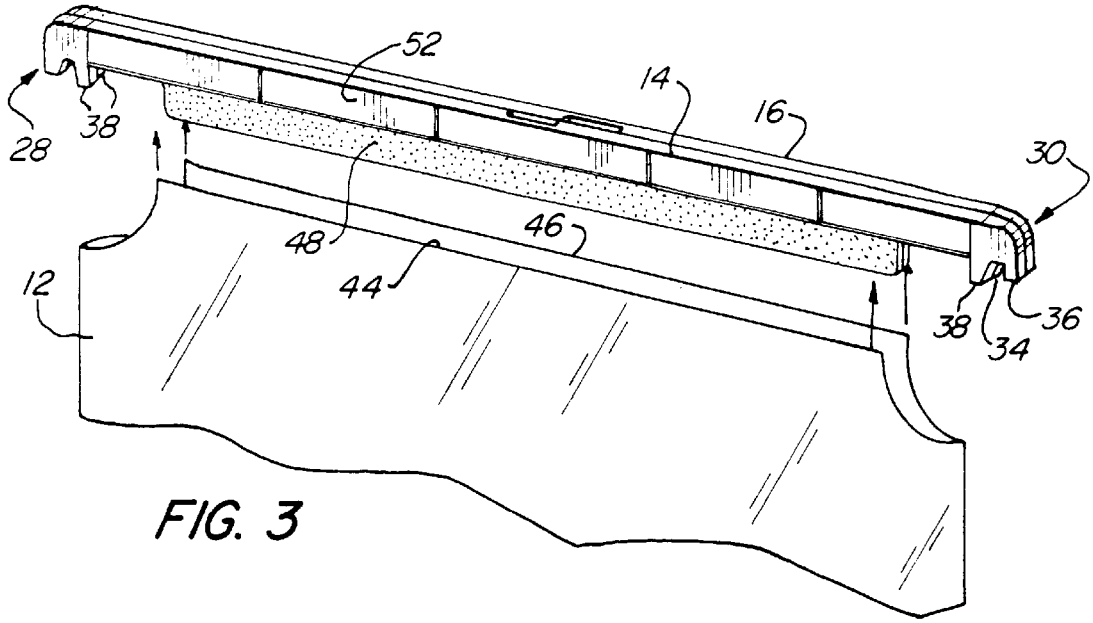
FIG. 3 is a perspective partial exploded view of the suspension bag and closure bars to which the bag is to be affixed.
Figure 5:
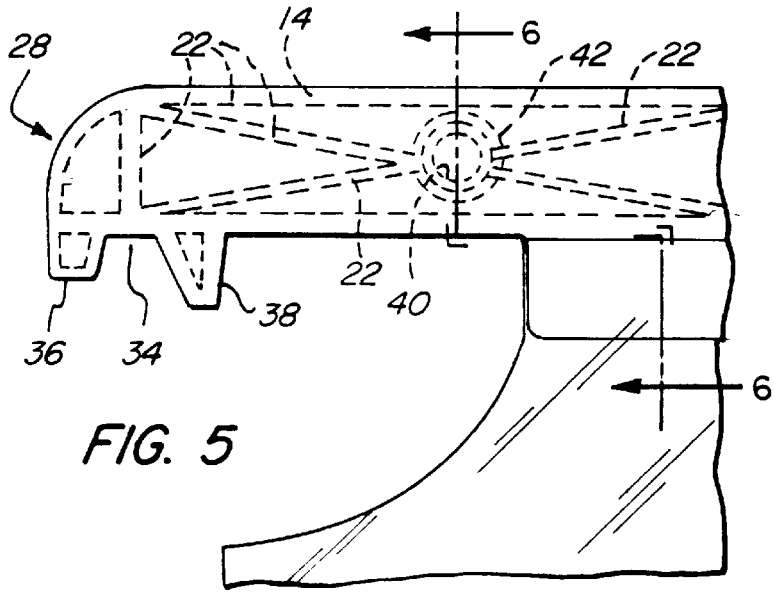
FIG. 5 is a partial enlarged view of an upper portion of the suspension bag of FIG. 1.
Figure 6:
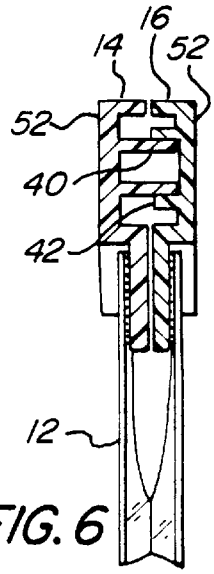
FIG. 6 is a section view of the closure bars used on the suspension bag in accordance with the invention and as taken along the line 6—6 in FIG. 5.

40, 42 as shown in the views of FIGS. 1, 5 and 6. Thus closure bar 14 can have the male elements 40 and closure bar 42 the female elements, though these could be distributed between the bars 14, 16. The elements frictionally interlock when the closure bars are closed as illustrated in FIG. 6. Separation of a closed bag 12 is achieved with the use of slots 43 in each of the closure bars 14, 16 and sized to receive a tip of a thumb to enable a person to pry the closure bars apart.

It is desirable that the suspension bag 10 can be opened with a sufficient width to insert bulky articles. This requires that the upper edges 44, 46 be separable for a sufficient distance. In the embodiment illustrated in FIGS. 1 and 3 this is achieved by cutting the upper corners of a rectangular bag 12 and thus reduce the length L of the portions of the upper edges 44, 46 that are attached to the outwardly facing bottom edges 48 of closure bars 14, 16. The edges 44, 46 can be affixed to edges 48 by way of a heat sealing or with a suitable adhesive.

Closure bars 14,16 are provided with generally flat side surfaces 52 suitable for receiving adhesive backed stickers, such as 54, on which appropriate file names can be placed to identify the suspension folder 10. The side surfaces 52 are shown divided into separate segments by low ridges 56, though such ridges can be dispensed with. The heights, h, of the side surfaces 52 are, therefore, selected sufficiently high to enable one to write or type a file name or number. The placement of the ridges 56 is selected so that ridges on different suspension folders 10 align with each other.

Figure 7:
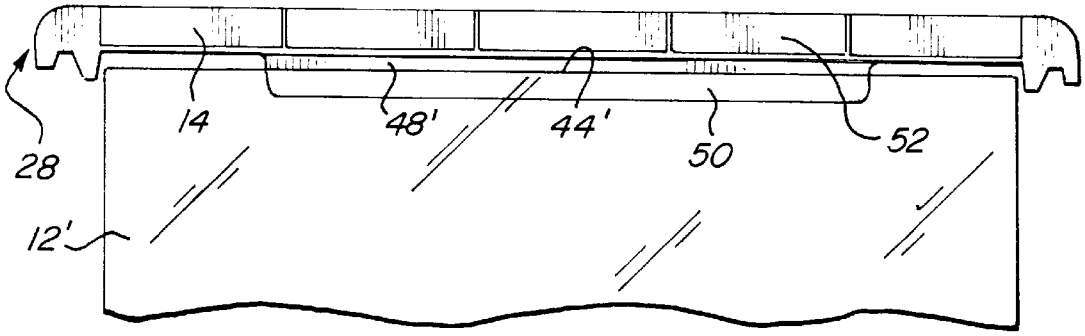
FIG. 7 is a partial view in elevation of an alternate form for a suspension bag in accordance with the invention.
Figure 8:
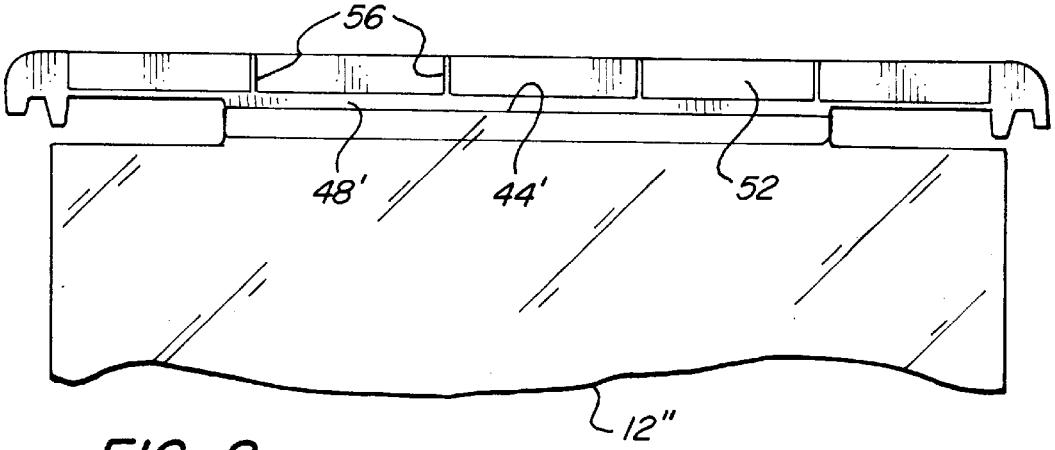
FIG. 8 is a partial view in elevation of still another form for a suspension bag in accordance with the invention.

Alternatively, as illustrated in FIGS. 7 and 8, the deletion of upper corner sections from bag 12' can be dispensed with. Thus the upper edges 44, 46 in FIG. 7 and 8 have a shorter portion 50 affixed to a correspondingly shorter bottom edge 48' of the closure bars 14, 16. The bag 12" in FIG. 8 has its upper corner cut in a rectangular shape to accommodate a combination of a smaller cut away corner and a shorter attachment portion to edge 48' for an adequate bag opening. As a result the separation of bars 14, 16 can be accommodated to achieve a desired opening. Alternatively the bag 12 can be formed so as to have appropriately sized gussets, not shown, but as commonly found in file folders, to enable a sufficient opening between the separated closure bars 14,16.

Having thus described several embodiments for a suspension bag in accordance with the invention its advantages can be appreciated. Variations from the illustrated embodiment can be made by one skilled in the art without departing from the scope of the claims as set forth below.

What is claimed is:

1. A suspension bag for storing articles in a suspension filing system using side rails to suspend the bag, comprising:

a bag shaped to hang inside the suspension filing system and having a closed bottom and closed sides, with the sides defining a width of the bag, and said suspension bag having an upper opening bounded by opposed edges;

first and second opposed elongate closure bars having lengths that exceed the width of the bag and being respectively affixed to said opposed edges with end segments of said closure bars extending past the sides of the bag; said end segments having recesses facing the closed bottom so as to enable the closure bars to be laterally retained and be vertically supported by the side rails used to suspend the bag in the filing system; said closure bars having juxtaposed interlocking and separable male and female closure elements to enable the bag opening to be closed and opened by forcing the closure bars apart to conveniently store articles in and retrieve articles from the bag while it is stored in the suspension filing system.

2. The suspension bag as claimed in claim 1 wherein the closure bars end segments have laterally spaced apart elements extending downwardly forming said recesses of the end segments.

3. The suspension bag as claimed in claim 1 wherein said closure bars are formed of plastic and each has a width that is less than about 3/16 of an inch and with said closure bars each having an internal structure formed with elongate ribs to provide sufficient strength to avoid sagging of the closure bars when installed on the side rails in the suspension filing system.

4. The suspension bag as claimed in claim 1 wherein the bag is transparent.

5. The suspension bag as claimed in claim 1 wherein said closure bars have outwardly facing side surfaces sized to receive file identifying stickers.

6. The suspension bag as claimed in claim 5 wherein said side surfaces have ridges, which are spaced apart from each other to divide the side surfaces into segments for receiving identifying stickers.

* * * * *